US011485157B2

(12) United States Patent
Shimojima et al.

(10) Patent No.: US 11,485,157 B2
(45) Date of Patent: Nov. 1, 2022

(54) CONVEYANCE DEVICE, APPLICATION DEVICE, PRINTER, AND SHEET CONVEYANCE APPARATUS

(71) Applicants: Kazuhiro Shimojima, Ibaraki (JP); Isao Matsushima, Ibaraki (JP)

(72) Inventors: Kazuhiro Shimojima, Ibaraki (JP); Isao Matsushima, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 17/087,026

(22) Filed: Nov. 2, 2020

(65) Prior Publication Data

US 2021/0138807 A1 May 13, 2021

(30) Foreign Application Priority Data

Nov. 9, 2019 (JP) ..... JP2019-203604
Jul. 30, 2020 (JP) ..... JP2020-128923

(51) Int. Cl.

| | |
|---|---|
| ***B41J 13/10*** | (2006.01) |
| ***B41J 11/00*** | (2006.01) |
| ***B65H 29/58*** | (2006.01) |
| ***B65H 31/00*** | (2006.01) |
| ***B41J 13/08*** | (2006.01) |

(Continued)

(52) U.S. Cl.

CPC ..... *B41J 13/103* (2013.01); *B41J 11/006* (2013.01); *B41J 11/0095* (2013.01); *B41J 13/08* (2013.01); *B65H 7/02* (2013.01); *B65H 29/58* (2013.01); *B65H 31/00* (2013.01); *B65H 31/02* (2013.01); *B65H 31/26* (2013.01); *G03G 21/1638* (2013.01); *B65H 2402/441* (2013.01); *B65H 2402/45* (2013.01); *B65H 2404/142* (2013.01);

(Continued)

(58) Field of Classification Search

CPC .... B41J 13/103; B41J 11/006; B41J 11/0095; B41J 13/08; B65H 7/02; B65H 29/58; B65H 31/00; B65H 31/02; B65H 31/26; B65H 2402/441; B65H 2402/45; B65H 2404/142; B65H 2404/144; B65H 2601/11; G03G 21/1638

See application file for complete search history.

(56) References Cited

U.S. PATENT DOCUMENTS

2006/0018672 A1* 1/2006 Asaba ..... G03G 15/70 399/21
2006/0103068 A1* 5/2006 Sekiya ..... B65H 29/52 271/264

(Continued)

FOREIGN PATENT DOCUMENTS

JP 2000-327170 A 11/2000
JP 2009-139438 A 6/2009

(Continued)

OTHER PUBLICATIONS

Extended European Search Report dated Mar. 29, 2021 issued in corresponding European Appln. No. 20204646.2.

*Primary Examiner* — Henok D Legesse
(74) *Attorney, Agent, or Firm* — Harness, Dickey & Pierce, P.L.C.

(57) ABSTRACT

A conveyance device includes a tray on an upper surface of the conveyance device and an upper guide below the tray. The tray receives a sheet, and the upper guide defines a conveyance path in which the sheet is conveyed. The upper guide is movable together with the tray to open the conveyance path.

17 Claims, 14 Drawing Sheets

(51) Int. Cl.

| | |
|---|---|
| ***B65H 31/26*** | (2006.01) |
| ***G03G 21/16*** | (2006.01) |
| ***B65H 7/02*** | (2006.01) |
| ***B65H 31/02*** | (2006.01) |

(52) U.S. Cl.
CPC .... *B65H 2404/144* (2013.01); *B65H 2601/11* (2013.01)

(56) References Cited

U.S. PATENT DOCUMENTS

| | | | | |
|---|---|---|---|---|
| 2009/0102908 | A1* | 4/2009 | Imoto | B41J 13/0054 347/104 |
| 2011/0227272 | A1* | 9/2011 | Kotera | G03G 15/6552 271/9.13 |
| 2015/0049356 | A1* | 2/2015 | Saitsu | G06K 15/4085 358/1.14 |
| 2017/0210578 | A1 | 7/2017 | Nakada et al. | |
| 2017/0210579 | A1 | 7/2017 | Watanabe et al. | |

FOREIGN PATENT DOCUMENTS

| | | | |
|---|---|---|---|
| JP | 2009-215064 | A | 9/2009 |
| JP | 2015-036741 | | 2/2015 |
| JP | 2017-019172 | | 1/2017 |
| JP | 2017-088378 | | 5/2017 |
| JP | 2018-005197 | A | 1/2018 |
| WO | WO-2008/108190 | A1 | 9/2008 |

* cited by examiner

CONVEYANCE DEVICE, APPLICATION DEVICE, PRINTER, AND SHEET CONVEYANCE APPARATUS

CROSS-REFERENCE TO RELATED APPLICATIONS

This patent application is based on and claims priority pursuant to 35 U.S.C. § 119(a) to Japanese Patent Application Nos. 2019-203604, filed on Nov. 9, 2019 and 2020-128923, filed on Jul. 30, 2020, in the Japan Patent Office, the entire disclosure of each of which is hereby incorporated by reference herein.

BACKGROUND

Technical Field

Embodiments of the present disclosure relate to a conveyance device, an application device, a printer, and a sheet conveyance apparatus.

Description of the Related Art

In a certain conveyance device to convey sheets, when the sheet is jammed in the conveyance device, the sheets remaining in the conveyance device, which are not jammed, are discharged to a tray for purging sheets.

SUMMARY

Embodiments of the present disclosure describe an improved conveyance device that includes a tray on an upper surface of the conveyance device and an upper guide below the tray. The tray receives a sheet, and the upper guide defines a conveyance path in which the sheet is conveyed. The upper guide is movable together with the tray to open the conveyance path.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
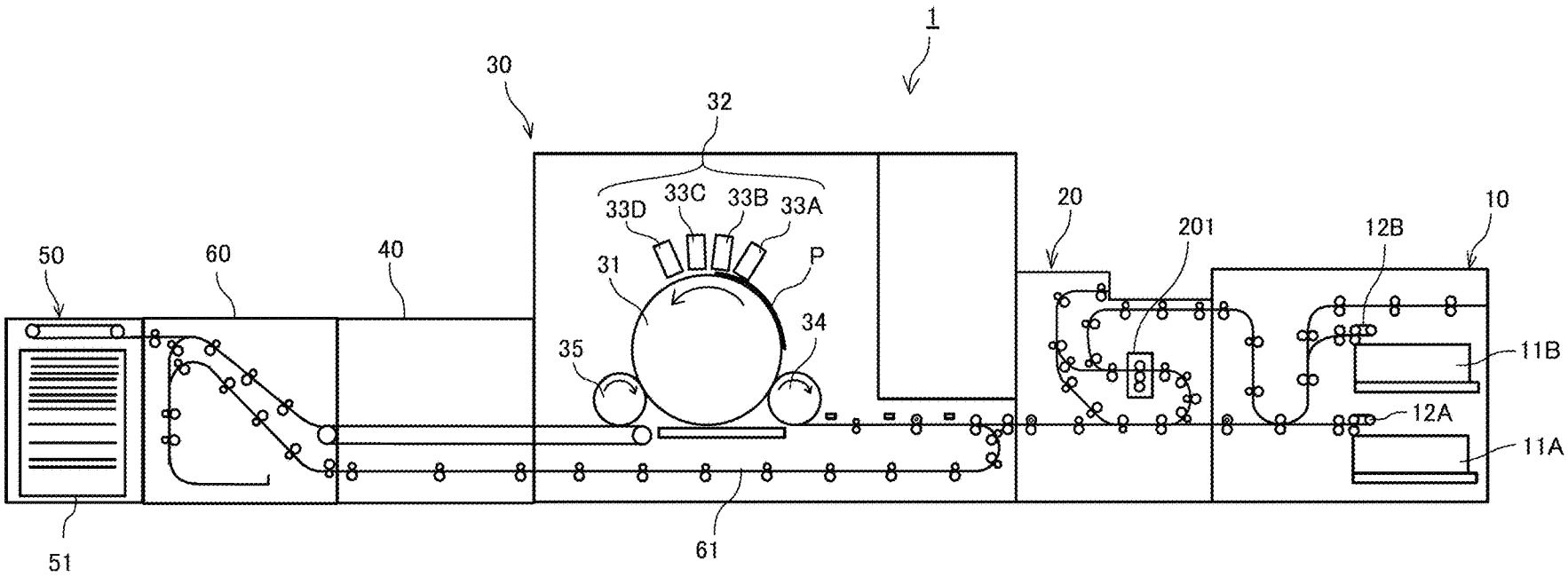
FIG. 1 is a schematic view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

There is known a conveyance device that includes a plurality of purge destinations on the upper surface of the conveyance device. The conveyance device conveys a sheet to the purge destination designated by a user. However, such a configuration for removing the sheet remaining in a conveyance path is likely to become large.

The present disclosure has been made in view of the foregoing, and an object of the present disclosure is to remove the sheet remaining in the conveyance path easily.

Embodiments of the present disclosure are described below with reference to the accompanying drawings. A printer 1 according to a first embodiment of the present disclosure is described with reference to FIG. 1. FIG. 1 is a schematic view of the printer 1.

The printer 1 includes a loading unit 10 to load a sheet P, a pretreatment unit 20, a printing unit 30, a drying unit 40, an ejection unit 50, and a reverse mechanism 60. The pretreatment unit 20 is constructed of an application device according to the present disclosure including a conveyance device according to the present disclosure. In the printer 1, the pretreatment unit 20 applies, as required, a pretreatment liquid onto the sheet P forwarded (supplied) from the loading unit 10, the printing unit 30 applies a liquid to the sheet P to perform required printing, the drying unit 40 dries the liquid adhering to the sheet P, and the sheet P is ejected to the ejection unit 50.

The loading unit 10 includes a lower loading tray 11A and an upper loading tray 11B to accommodate a plurality of sheets P and feeding units 12A and 12B to separate and forward the sheets P one by one from the lower and upper loading trays 11A and 11B, thereby supplying the sheets P to the pretreatment unit 20. The pretreatment unit 20 includes an application unit 201 that coats a printing surface of the sheet P with a treatment liquid having an effect of aggregating a colorant of ink to prevent bleed-through.

The printing unit 30 includes a drum 31 and a liquid discharge device 32. The drum 31 is a bearer (rotating member) that bears the sheet P on the circumferential surface of the drum 31 and rotates. The liquid discharge device 32 discharges a liquid toward the sheet P borne on the drum 31. The printing unit 30 further includes transfer cylinders 34 and 35. The transfer cylinder 34 receives the sheet P from the pretreatment unit 20 and forwards the sheet P to the drum 31. The transfer cylinder 35 receives the sheet P conveyed by the drum 31 and forwards the sheet P to the drying unit 40.

The transfer cylinder 34 includes a sheet gripper to grip a leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31. Similarly, the drum 31 includes a sheet gripper on the surface of the drum 31, and the leading end of the sheet P is gripped by the sheet gripper of the drum 31. The drum 31 has a plurality of suction holes dispersedly on the surface of the drum 31, and a suction unit generates suction airflows directed inward from suction holes of the drum 31. On the drum 31, the sheet gripper grips the leading end of the sheet P forwarded from the transfer cylinder 34, and the sheet P is attracted to and borne on the drum 31 by the suction airflows by the suction unit. As the drum 31 rotates, the sheet P is conveyed.

The liquid discharge device 32 includes discharge units 33 (discharge units 33A to 33D) to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used. The discharge unit 33 is a full line head and includes, for example, a plurality of liquid discharge heads disposed in a staggered arrangement on a base. Each of the liquid discharge head includes a plurality of nozzle rows, and a plurality of nozzles is arranged in each of the nozzle rows. The discharge operation of each of the discharge units 33 of the liquid discharge device 32 is controlled by a drive signal corresponding to print data. When the sheet P borne on the drum 31 passes through a region facing the liquid discharge device 32, the liquids of respective colors are discharged from the discharge units 33, and an image corresponding to the print data is formed on the sheet P.

The drying unit 40 dries the liquid applied onto the sheet P by the printing unit 30. Thus, a liquid component such as moisture in the liquid evaporates, and the colorant contained in the liquid is fixed on the sheet P. Additionally, curling of the sheet P is restrained. The reverse mechanism 60 reverses, in switchback manner, the sheet P that has passed through the drying unit 40 in duplex printing. The reversed sheet P is fed back to the upstream side of the transfer cylinder 34 through a conveyance passage 61 of the printing unit 30. The ejection unit 50 includes an ejection tray 51 on which a plurality of sheets P is stacked. The plurality of sheets P conveyed through the reverse mechanism 60 from the drying unit 40 is sequentially stacked and held on the ejection tray 51.

Note that, in the present embodiment, the printing unit 30 includes the liquid discharge device 32 including the discharge units 33 serving as an image forming unit to form an image on the sheet P. However, the present disclosure can be applied to a printer including a unit other than the discharge unit 33, for example, an electrophotographic image forming unit to from an image.

Figure 2:
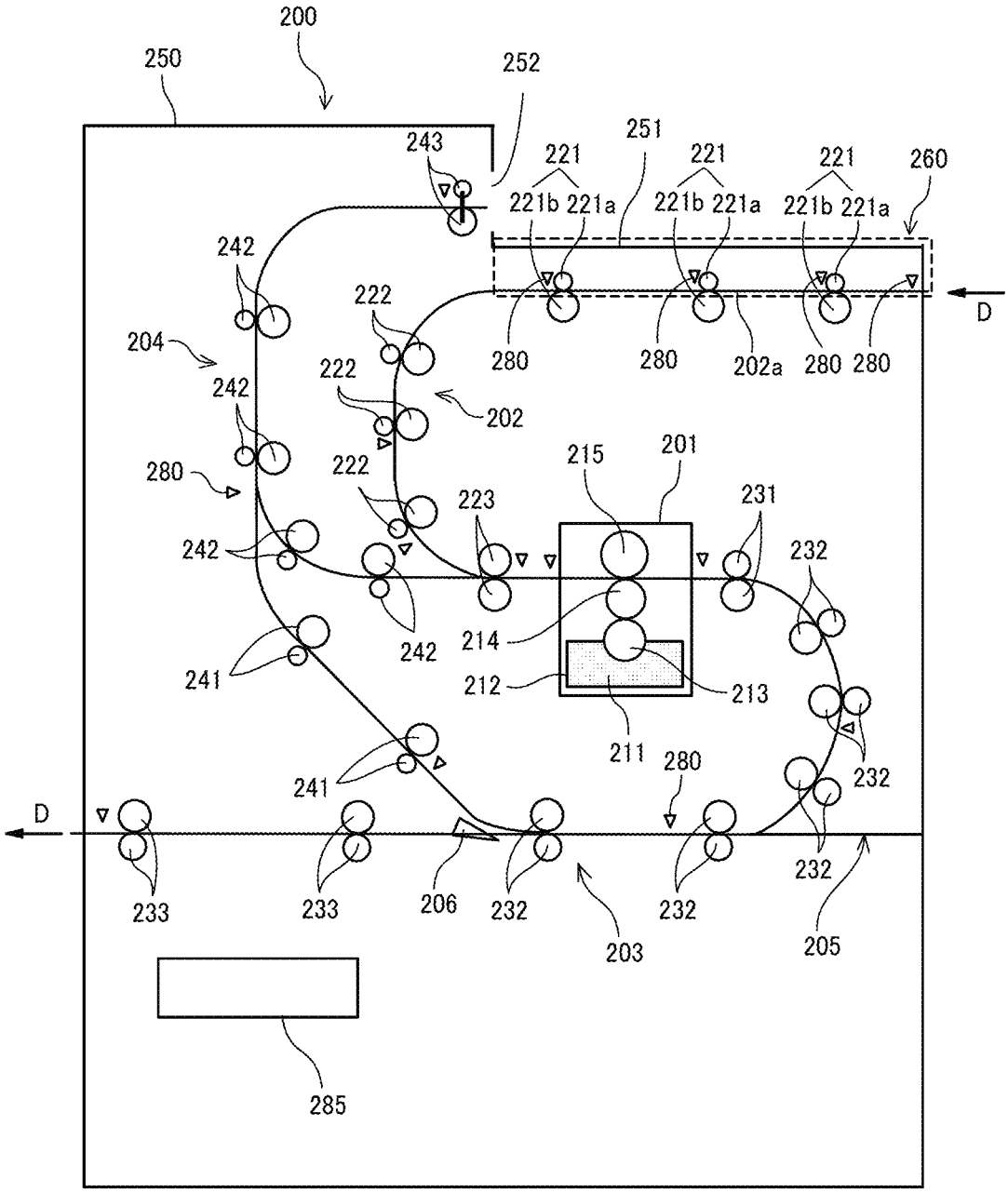
FIG. 2 is a side view of an application device including a conveyance device according to the first embodiment of the present disclosure.

With reference to FIG. 2, a description is given below of an application device 200 including a conveyance device according to the first embodiment of the present disclosure. FIG. 2 is a side view of the application device 200 constructing the pretreatment unit 20 of the printer 1. The application device 200 includes the application unit 201 that coats the sheet P with a treatment liquid 211 as a coating liquid, an upstream conveyance path 202, a downstream conveyance path 203, a reverse conveyance path 204, and a straight conveyance path 205. The upstream conveyance path 202 is disposed upstream from the application unit 201, and the downstream conveyance path 203 is disposed downstream from the application unit 201 in a direction of conveyance of the sheet P indicated by arrow D in FIG. 2 (hereinafter, referred to as a sheet conveyance direction).

The application unit 201 includes a treatment liquid tank (supply pan) 212 to store the treatment liquid 211, a draw-up roller 213 to draw the treatment liquid 211, and an application roller 214 to coat the sheet P with the treatment liquid 211. The application unit 201 further includes a pressure roller 215 opposed to the application roller 214. In the application unit 201, the draw-up roller 213 draws the treatment liquid 211 and form a liquid film on the circumferential surface of the application roller 214. When an upstream conveyance roller pair 223 and a downstream conveyance roller pair 231 convey the sheet P, the sheet P is coated with the treatment liquid 211 while passing through the nip between the application roller 214 and the pressure roller 215.

In the upstream conveyance path 202, the sheet P forwarded to the application device 200 is conveyed toward the application unit 201. A plurality of conveyance roller pairs 221 and a plurality of conveyance roller pairs 222 are disposed in the upstream conveyance path 202 to convey the sheet P to the upstream conveyance roller pair 223 disposed upstream from the application unit 201.

In the downstream conveyance path 203, the sheet P coated with the treatment liquid 211 by the application unit 201 is conveyed toward the printing unit 30 disposed downstream from the application device 200. A plurality of conveyance roller pairs 232 and a plurality of conveyance roller pairs 233 are disposed in the downstream conveyance path 203. The plurality of conveyance roller pairs 232 conveys the sheet P forwarded by the downstream conveyance roller pair 231 disposed immediately downstream from the application unit 201. The plurality of conveyance roller pairs 233 conveys the sheet P to the device disposed downstream from the application device 200 (i.e., the printing unit 30 in the present embodiment).

When the treatment liquid 211 is applied to both surfaces of the sheet P, the sheet P is conveyed from the middle of the downstream conveyance path 203 to the reverse conveyance path 204 by a separator 206 after the treatment liquid 211 is applied to one surface of the sheet P. Then, the sheet P is reversed in the reverse conveyance path 204 and conveyed again toward the upstream conveyance roller pair 223. A plurality of conveyance roller pairs 241, a plurality of conveyance roller pairs 242, and a discharge roller pair 243 for purging the sheet P are disposed in the reverse conveyance path 204. The discharge roller pair 243 discharges the sheet P outside a device body 250 of the application device 200.

When the treatment liquid 211 is not applied to the sheet P by the application unit 201, the sheet P forwarded from the loading unit 10 is conveyed in the straight conveyance path 205 and further conveyed into the middle of the downstream conveyance path 203. Note that, if the application unit 201 is switchable whether or not to apply the treatment liquid 211 to the sheet P, the straight conveyance path 205 is unnecessary, and the sheet P can be conveyed from the upstream conveyance path 202 to the downstream conveyance path 203 without applying the treatment liquid 211.

Sheet detectors 280 to detect the sheet P are disposed in the upstream conveyance path 202, at the inlet and the outlet of the application unit 201, in the downstream conveyance path 203, in the reverse conveyance path 204, and in the vicinity of the discharge roller pair 243. The reference numerals of some of the sheet detectors 280 are omitted in FIG. 2. When the sheet detector 280 detects that the sheet P is staying or does not arrive at the position facing the sheet detectors 280 at a predetermined timing, the sheet detector 280 determines that the sheet P is jammed (i.e., sheet jam).

Figure 3:
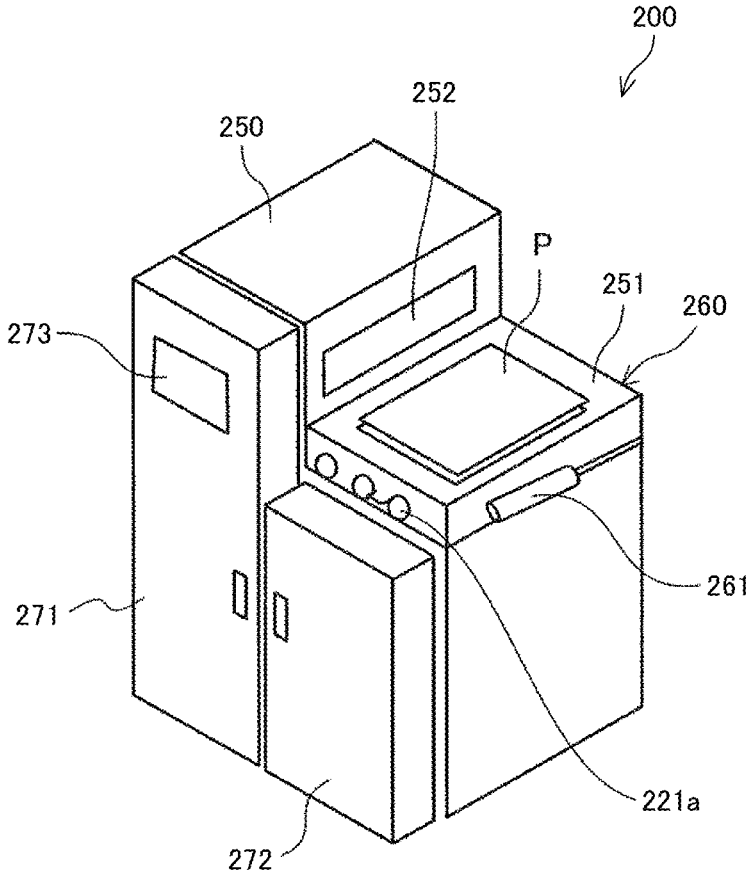
FIG. 3 is an exterior perspective view of the application device.

Next, the configuration regarding purge of the sheet P in the application device 200 according to the present embodiment is described with reference also to FIG. 3. FIG. 3 is an exterior perspective view of the application device 200.

A tray 251 is disposed on the upper surface of the device body (housing) 250 of the application device 200 to receive the sheet P. For example, the sheet P to be purged is discharged to the tray 251 through an opening 252 of the device body 250 by the discharge roller pair 243. When the sheet P is reversed in the reverse conveyance path 204, a part of the sheet P may emerge from the opening 252 onto the tray 251. A conveyance path 202*a* that is a part of the upstream conveyance path 202 is disposed below the tray 251. The conveyance path 202*a* is defined by the plurality of conveyance roller pairs 221. The plurality of conveyance roller pairs 221 includes upper rollers 221*a* as an upper guide and lower rollers 221*b* as a lower guide.

The tray 251 and the upper rollers 221*a* of the conveyance roller pair 221, which is the upper guide of the conveyance path 202*a* disposed below the tray 251, integrally construct a tray unit 260. In FIG. 3, the upper rollers 221*a* can be seen from the front side of the tray unit 260 for explanation, but the upper rollers 221*a* are housed in the tray unit 260. The rear side of the tray unit 260 is supported by the device body 250 and the front side of the tray unit 260 is movable upward with respect to the device body 250. The tray unit 260 is swingable around the rear side of the tray unit 260 supported by the device body 250. That is, the upper rollers 221*a* moves together with the tray 251 to open the conveyance path 202*a*. Further, a damper 261 as a retainer is disposed between the tray unit 260 and the device body 250 to retain the opened state of the tray unit 260.

A left front door 271 and a right front door 272 are disposed on the front of the device body 250 and are closably openable. A display panel 273 is disposed on the left front door 271.

Figure 4A:
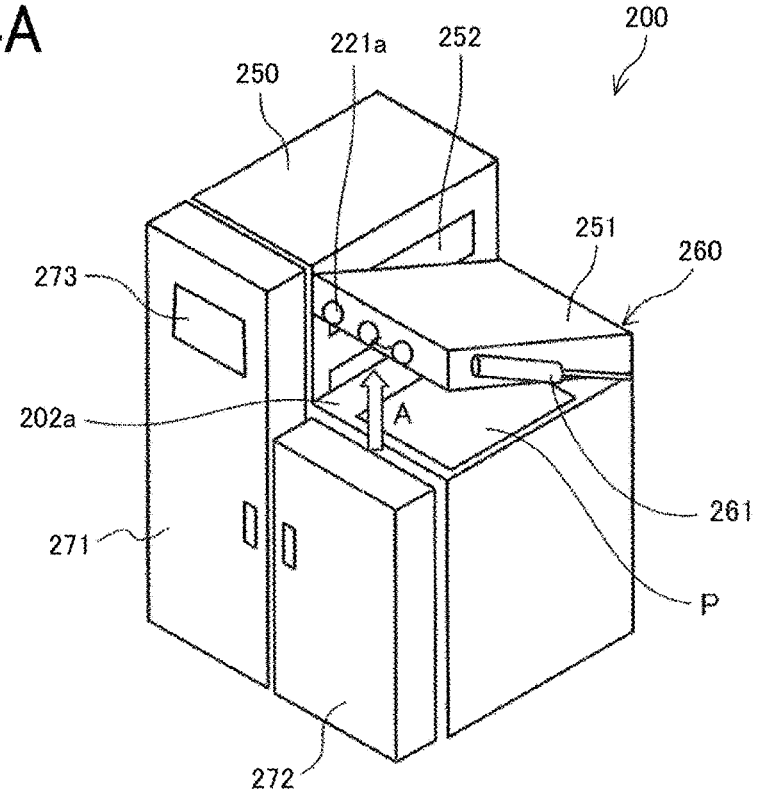
FIGS. 4A and 4B are perspective views illustrating the operation of the application device.
Figure 4B:
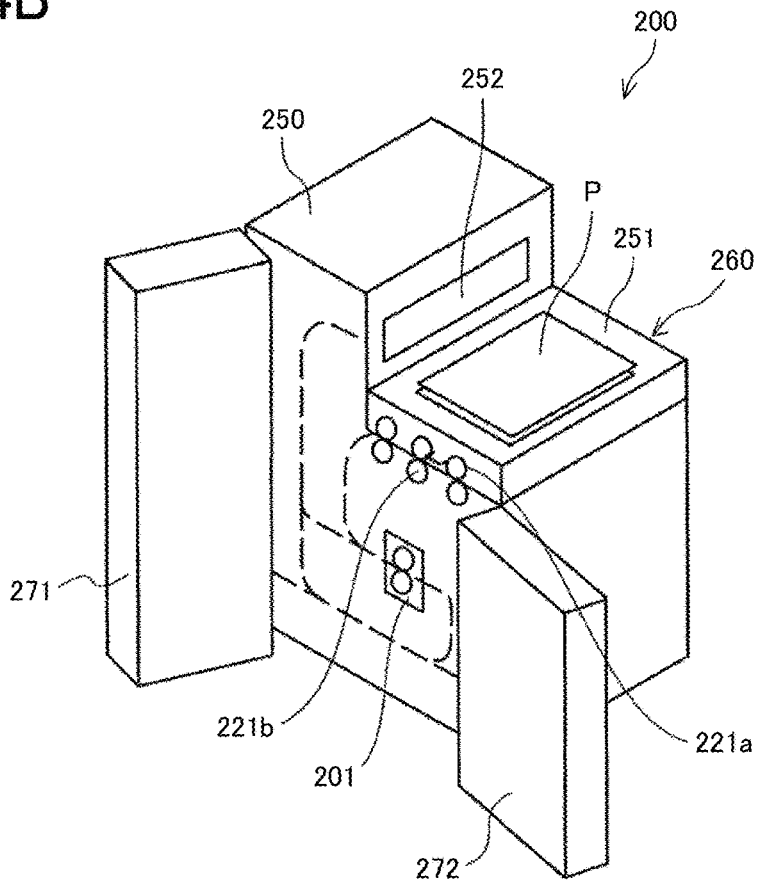

Next, the operation of the application device 200 is described with reference also to FIGS. 4A and 4B. FIGS. 4A and 4B are perspective views illustrating the operation of the application device 200.

A controller 285 as circuitry (see FIG. 2) of the application device 200 controls the conveyance of the sheet P. When the sheet P is jammed in the conveyance path 202*a* of the application device 200, for example, the controller 285 stops the sheet P located in the conveyance path 202*a*, and purges the sheets P located at other positions (the sheets P that have passed through the application unit 201) onto the tray 251 collectively as illustrated in FIG. 3. After that, the controller 285 notifies a user of the occurrence of the jam by the display panel 273 disposed on the left front door 271 of the application device 200.

At this time, as illustrated in FIG. 4A, the user removes the sheets P discharged onto the tray 251, and then lifts and swings (moves) the front side of the tray unit 260 in the direction indicated by arrow A to open the conveyance path 202*a*. Thus, the user removes the sheet P remaining in the conveyance path 202*a* to clear the jam. Therefore, by simply swing (moving) the tray unit 260, which is constructed of the tray 251 and the upper rollers 221*a* as a single unit, the conveyance path 202*a* below the tray 251 can be opened, thereby facilitating the jam handling. In the present embodiment, after the occurrence of the jam, all the sheets P are collected in the tray 251 and the conveyance path 202*a* disposed immediately below the tray 251, and the jam handling can be performed only by swinging the tray 251 (tray unit 260). This configuration facilitates removing the sheets P.

Figure 5:
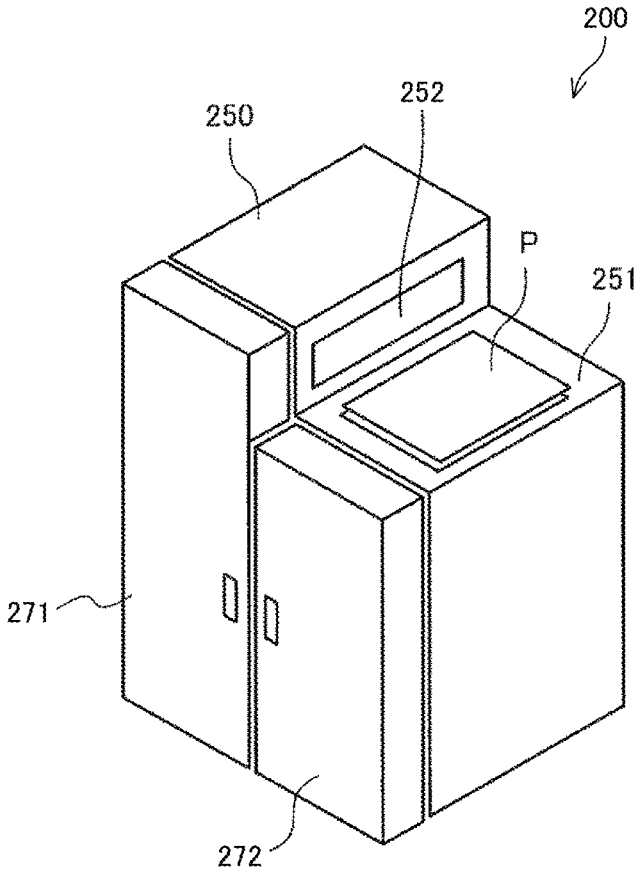
FIG. 5 is an exterior perspective view of an application device according to a first comparative example.
Figure 6A:
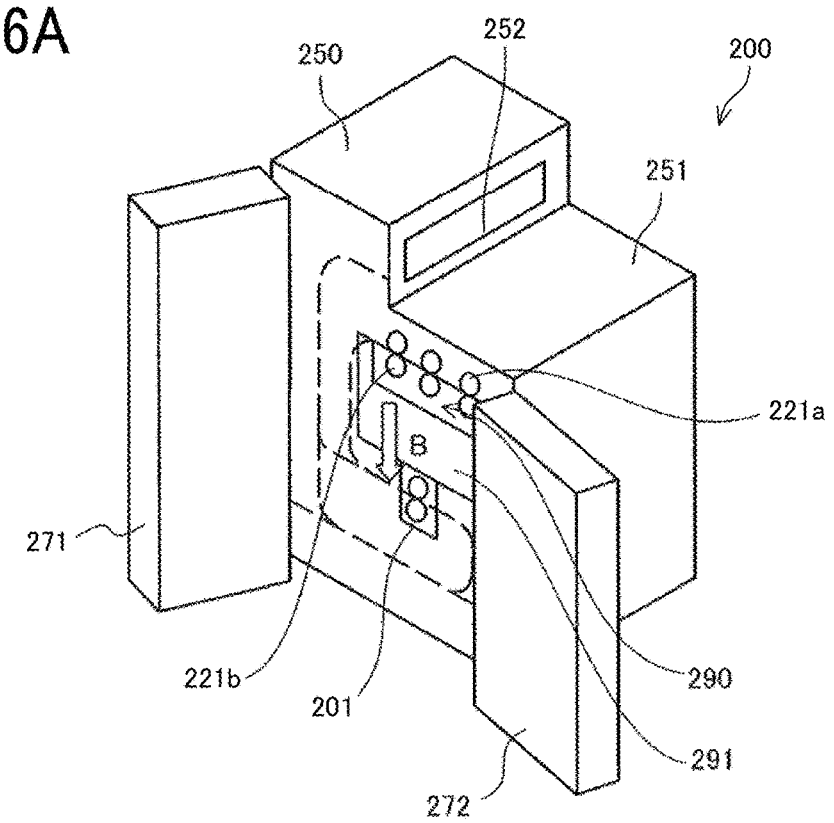
FIGS. 6A and 6B are perspective views illustrating the operation of the application device according to the first comparative example.
Figure 6B:
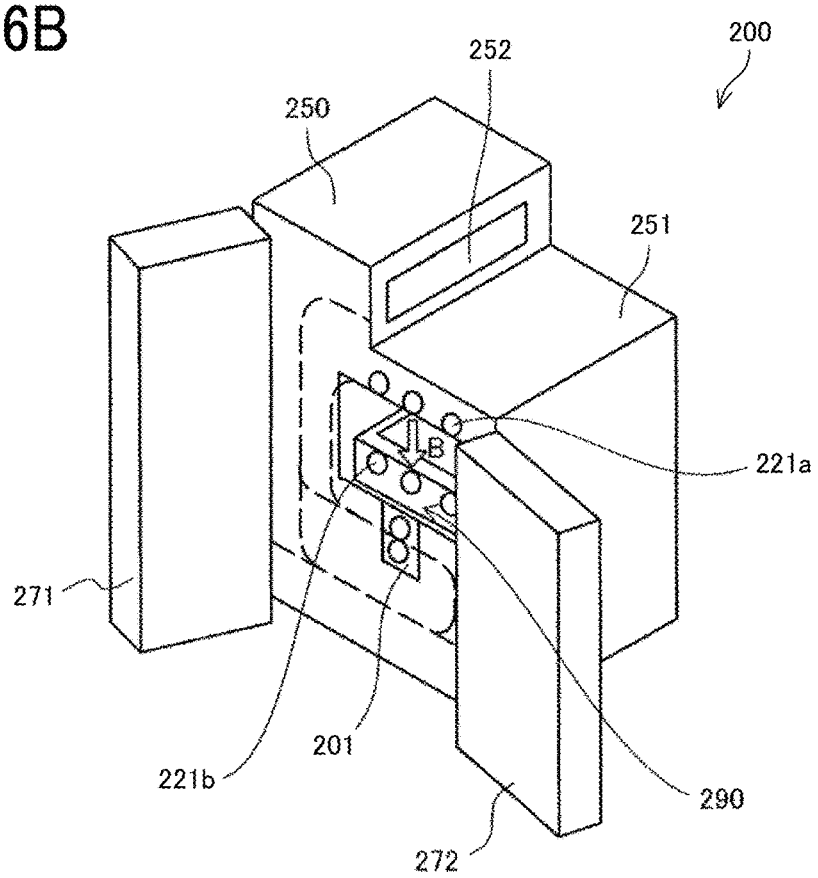

A first comparative example is described with reference to FIGS. 5, 6A, and 6B. FIG. 5 is an exterior perspective view of an application device 200 according to the first comparative example, and FIGS. 6A and 6B are perspective views illustrating the operation of the application device 200 according to the first comparative example. In the first comparative example, a roller unit 290 including the lower rollers 221*b* of the conveyance path 202*a* disposed below the tray 251 is movable in the direction indicated by arrow B. With such a configuration, when a jam occurs, for example, the front side of the roller unit 290 is lowered from the state illustrated in FIG. 6A to the state illustrated in FIG. 6B in the downward direction indicated by arrow B to open the conveyance path 202*a*. In such a configuration, a space 291 for moving the roller unit 290 is required below the conveyance path 202*a*. As a result, the size of the device becomes large, and the visibility inside the conveyance path 202*a* deteriorates.

On the other hand, in the present embodiment, as illustrated in FIG. 4B, a space below the conveyance path 202*a* is unnecessary, thereby preventing the device from increasing the size. Further, as illustrated in FIG. 4A, the tray unit 260 moves upward, thereby improving the visibility of the conveyance path 202*a* that is opened.

Figure 7:
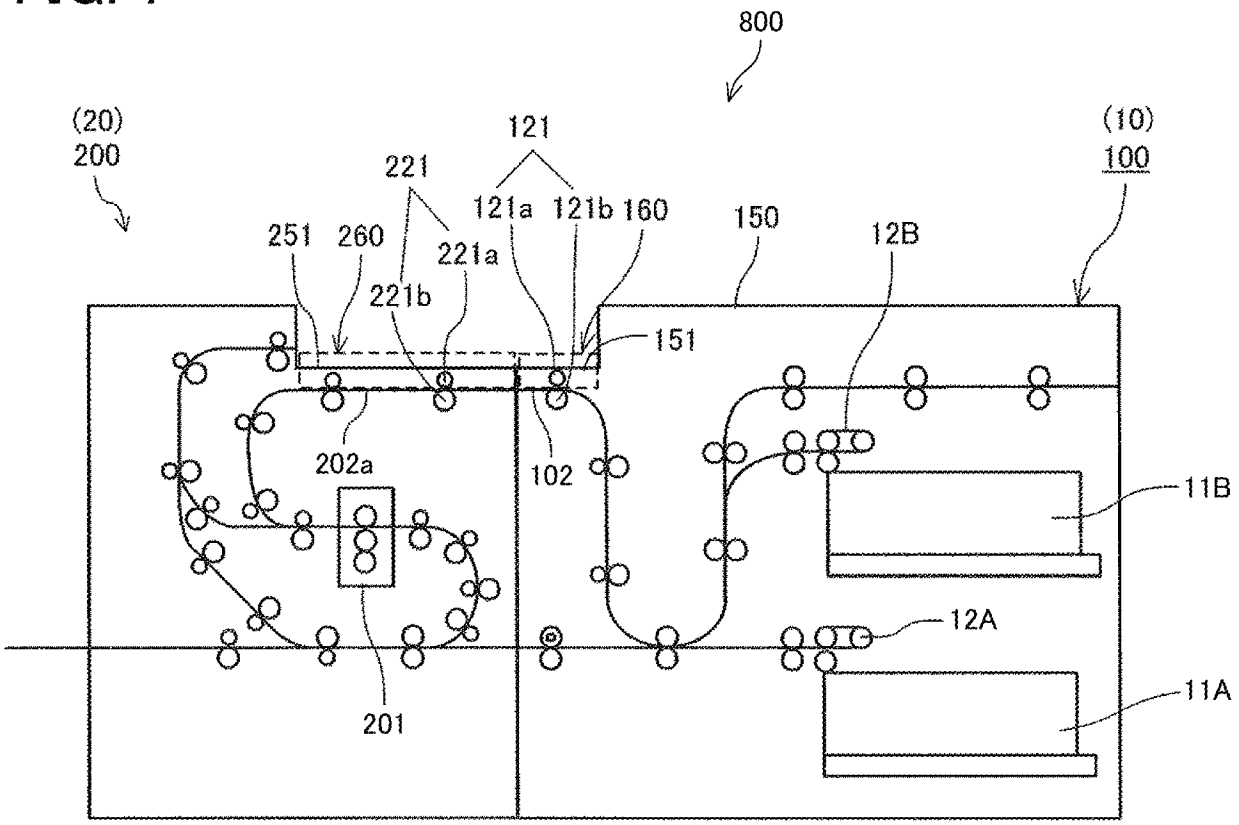
FIG. 7 is a schematic view of a sheet conveyance apparatus according to a second embodiment of the present disclosure.
Figure 8:
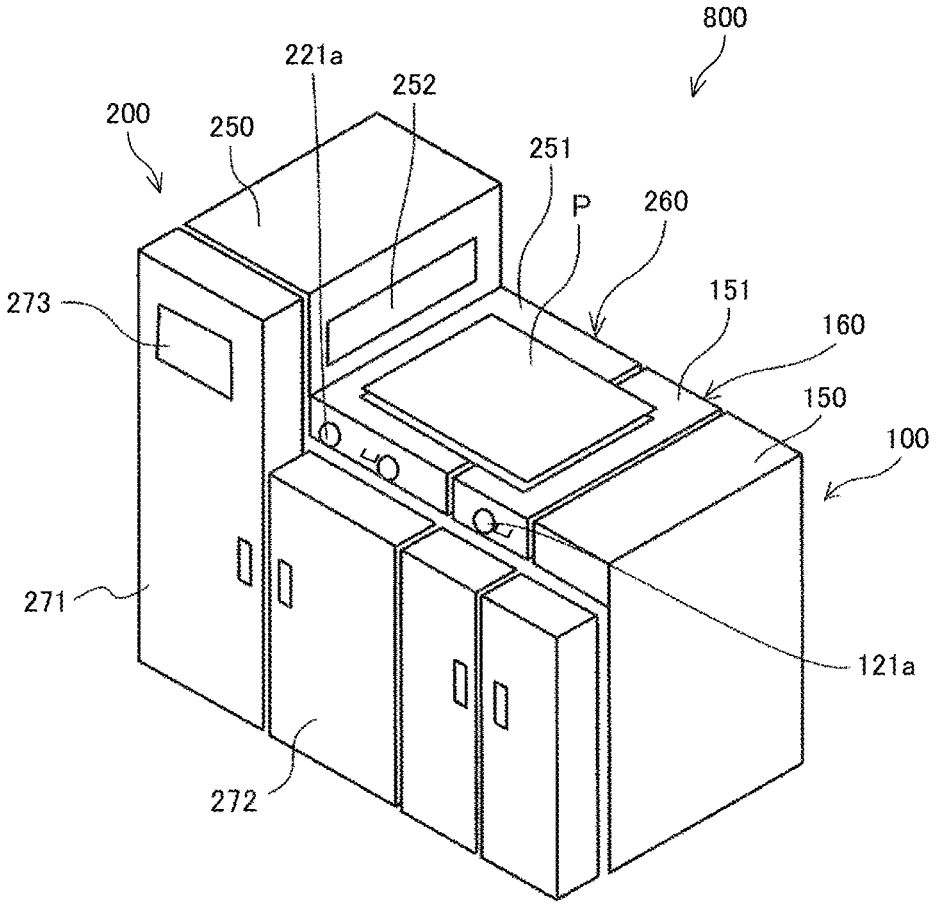
FIG. 8 is an exterior perspective view of the sheet conveyance apparatus according to the second embodiment.
Figure 9:
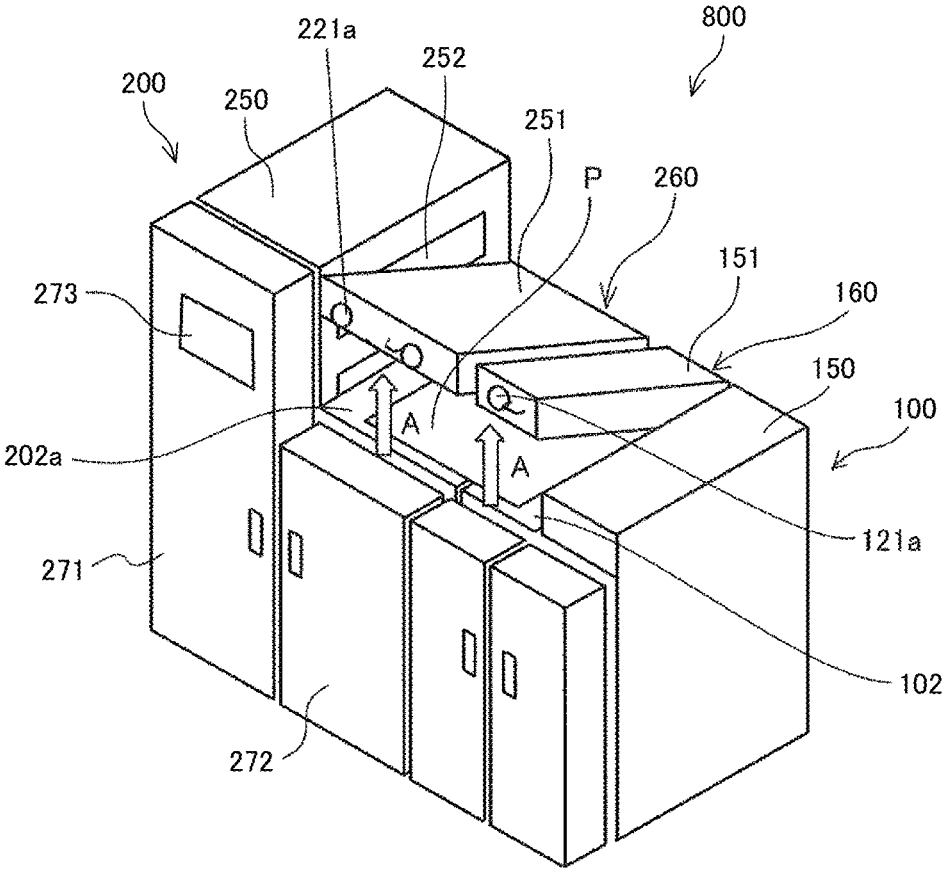
FIG. 9 is a perspective view of the sheet conveyance apparatus with a tray unit opened according to the second embodiment.

Next, a second embodiment of the present disclosure is described with reference to FIGS. 7 to 9. FIG. 7 is a schematic view of a sheet conveyance apparatus 800 according to the second embodiment. FIG. 8 is an exterior perspective view of the sheet conveyance apparatus 800 according to the second embodiment. FIG. 9 is a perspective view of the sheet conveyance apparatus 800 with tray units 160 and 260 opened.

The sheet conveyance apparatus 800 according to the present embodiment includes the application device 200 (pretreatment unit 20) described in the first embodiment, and a loading device 100 (corresponding to the loading unit 10) that is an upstream device disposed upstream from the application device 200 in the sheet conveyance direction to forward the sheet P to the application device 200. The application device 200 is the same as the first embodiment except that the number of the conveyance roller pairs 221 in the conveyance path 202*a* is two. The loading device 100 includes an extension tray 151 to extend the tray 251 of the application device 200, and another conveyance path 102 through which the sheet P is conveyed is disposed below the extension tray 151. Another conveyance roller pair 121 defines the conveyance path 102 and includes another upper roller 121*a* as the upper guide and another lower roller 121*b* as the lower guide.

The extension tray 151 and the upper roller 121*a* of the conveyance path 102 disposed below the extension tray 151 integrally construct a tray unit 160. The tray unit 160 is movably (swingably) supported by a device body 150 of the loading device 100. Thus, by swinging the tray unit 160 including the extension tray 151, the conveyance path 102 disposed below the extension tray 151 can be opened. With this configuration, as illustrated in FIG. 8, the sheet P protruding from the application device 200 can also be discharged onto the tray 251 and the extension tray 151. Further, similarly to the first embodiment, as illustrated in FIG. 9, the jammed sheet P remaining across the conveyance path 202*a* and the conveyance path 102 can be easily removed.

Figure 10:
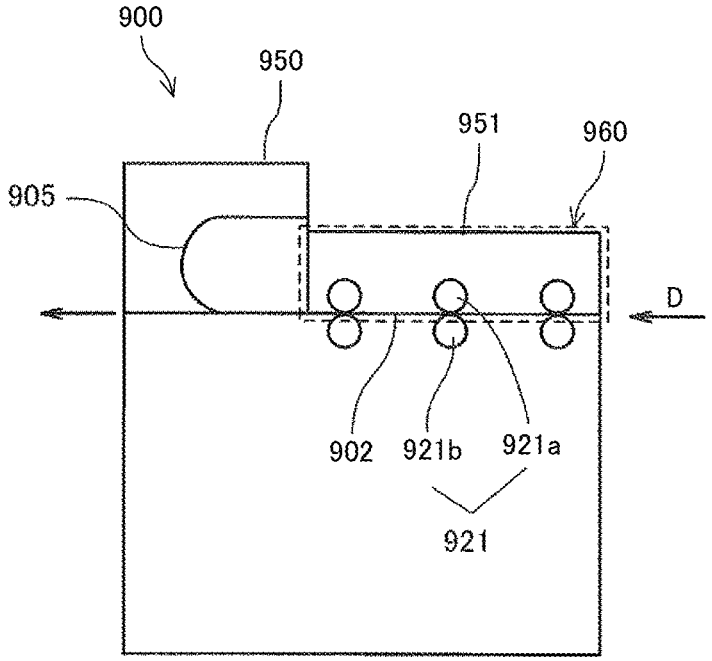
FIG. 10 is a schematic view of a conveyance device according to a third embodiment of the present disclosure.

Next, a third embodiment of the present disclosure is described with reference to FIG. 10. FIG. 10 is a schematic view of a conveyance device 900 according to the third embodiment. A tray 951 is disposed on the upper surface of a device body 950 of the conveyance device 900 to receive the sheet P. A conveyance path 902 through which the sheet P is conveyed in the direction indicated by arrow D is disposed below the tray 951. A plurality of conveyance roller pairs 921 is disposed in the conveyance path 902 and includes upper rollers 921*a* as the upper guide and lower rollers 921*b* as the lower guide.

The tray 951 and the upper rollers 921*a* of the conveyance path 902 disposed below the tray 951 integrally construct a tray unit 960. The tray unit 960 is movably (swingably) supported by a device body 950 of the conveyance device 900. Further, a conveyance path 905 through which the sheet P is conveyed from the conveyance path 902 to the tray 951 is provided. With this configuration, by swinging the tray unit 960, the conveyance path 902 disposed below the tray 951 can be opened. Thus, similarly to the first embodiment, the sheet P remaining in the conveyance path 902 can be easily removed.

Figure 11:
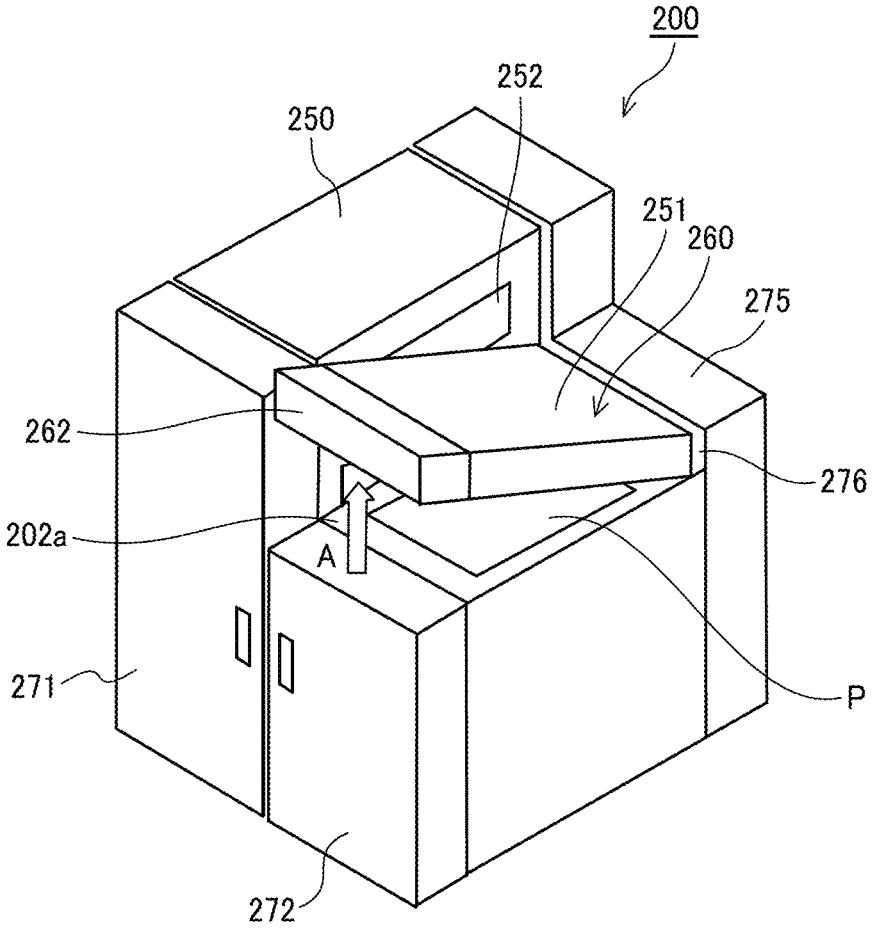
FIG. 11 is an exterior perspective view of an application device according to a fourth embodiment of the present disclosure.
Figure 12A:
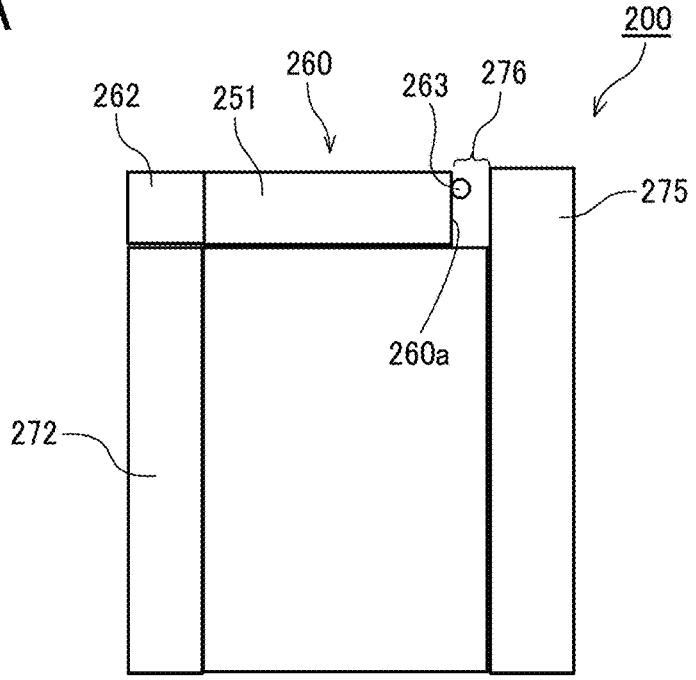
FIGS. 12A and 12B are schematic views illustrating the operation of the application device according to the fourth embodiment.
Figure 12B:
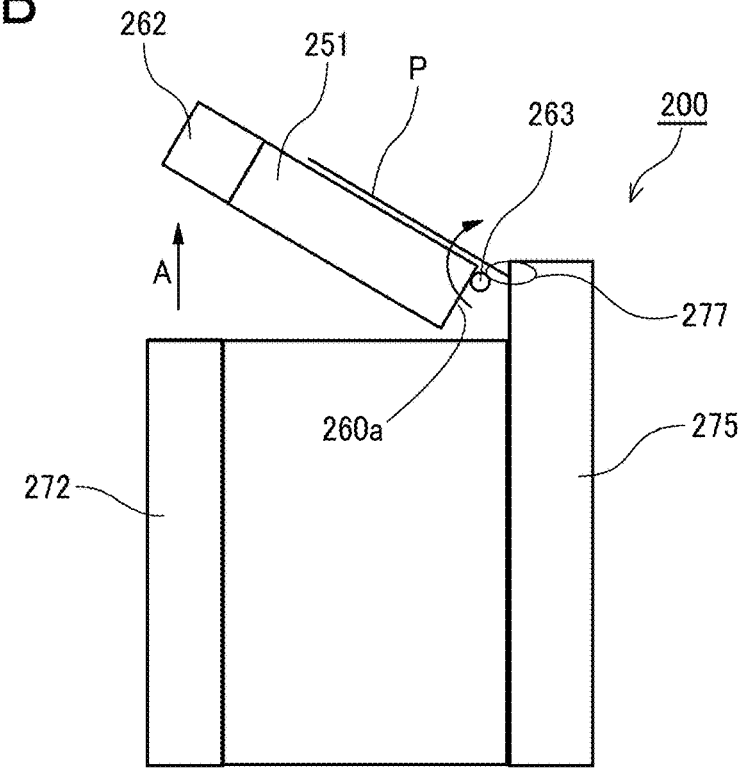

A fourth embodiment of the present disclosure is described with reference to FIGS. 11, 12A, and 12B. FIG. 11 is an exterior perspective view of an application device 200 according to the fourth embodiment. FIGS. 12A and 12B are schematic views illustrating the operation of the application device 200 according to the fourth embodiment. In the present embodiment, a front cover 262 serving as an exterior is disposed in front of the tray unit 260 that is integrally constructed of the tray 251 and the upper rollers 221*a* as the upper guide. The front cover 262 is flush with the right front door 272 and covers the upper rollers 221*a*. A hinge 263 that swingably supports the tray unit 260 is disposed on a rear face 260*a* of the tray 251 of the tray unit 260. With this configuration, the front side of the tray unit 260 moves in the vertical direction around the hinge 263 as a rotation fulcrum. The conveyance path 202*a* is opened by lifting the front side of the tray unit 260. A rear frame 275 is disposed behind the tray unit 260. A gap 276 is provided between the rear face 260*a* of the tray unit 260 and the rear frame 275.

With this configuration, the front side of the tray unit 260 is lifted from the state illustrated in FIG. 12A to the state illustrated in FIGS. 11 and 12A in the direction indicated by arrow A, and the tray unit 260 is swung around the hinge 263 as the rotation fulcrum, thereby opening the conveyance path 202*a*. At this time, as illustrated in FIGS. 11 and 12B, the tray 251 of the tray unit 260 is inclined with the hinge 263 down. Therefore, if the sheet P remains on the tray 251, the sheet P slides toward the rear side of the tray 251. As illustrated in FIG. 12B, because of the gap 276, the rear end of the sheet P contacts a step 277 formed between the rear face 260*a* of the tray unit 260 and the rear frame 275. As a result, the sheet P does not fall off. Thus, when the tray unit 260 is opened, even if the sheet P remains on the tray 251, the sheet P is prevented from falling from the tray 251.

Figure 13:
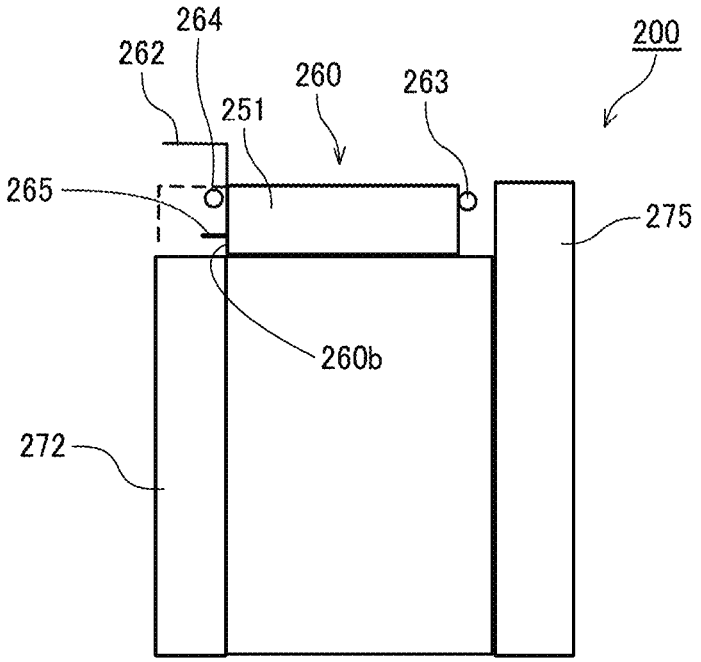
FIG. 13 is a schematic view of an application device according to a fifth embodiment of the present disclosure.
Figure 14:
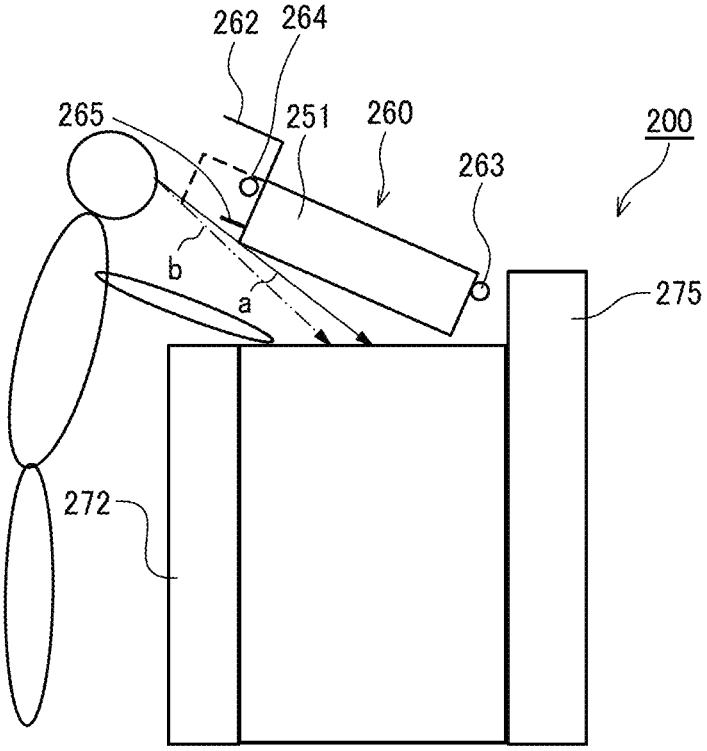
FIG. 14 is a schematic view illustrating the operation of the application device according to the fifth embodiment.

A fifth embodiment of the present disclosure is described with reference to FIGS. 13 and 14. FIG. 13 is a schematic view of an application device 200 according to the fifth embodiment. FIG. 14 are schematic view illustrating the operation of the application device 200 according to the fifth embodiment. In the present embodiment, the front cover 262 of the tray unit 260 has an L-shaped cross section and is movable (swingable) between an open position indicated by a solid line and a closed position indicated by a broken line in FIGS. 13 and 14 around a hinge 264 in the vertical direction.

Further, an operation handle 265 as an operation member is disposed on a front face 260*b* of the tray unit 260 to release or set a latch of the tray unit 260. Here, the operation handle 265 has a length (i.e., the amount of protrusion of the operation handle 265 from the front face 260*b* of the tray 251 of the tray unit 260) such that the operation handle 265 can be accommodated in the front cover 262 when the front cover 262 is closed. As described above, since the front cover 262 is closably openable, the length of the operation handle 265 can be set so that the operation handle 265 fits inside the front cover 262. Therefore, the length of the operation handle 265 can be shortened as compared with a second comparative example described below.

Figure 15:
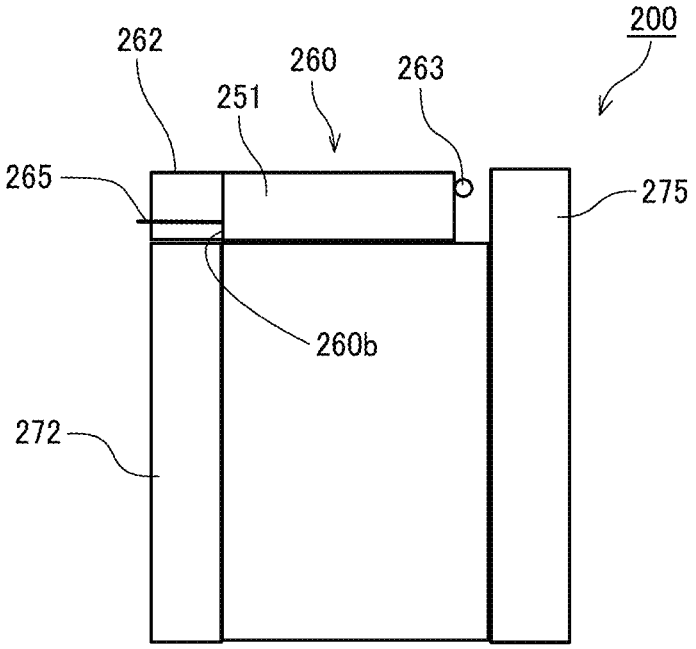
FIG. 15 is a schematic view of an application device according to a second comparative example.

The second comparative example is described with reference to FIG. 15. FIG. 15 is a schematic view of an application device 200 according to the second comparative example. In the second comparative example, the front cover 262 is integrally formed with the tray 251. In this case, the operation handle 265 is required to have a length so as to protrude from the front cover 262. Therefore, in the second comparative example, the length of the operation handle 265 becomes longer than that of the present embodiment. As a result, the operation handle 265 may bend and fail to release or set the latch of the tray unit 260.

Further, in the present embodiment, as illustrated in FIG. 14, when the tray unit 260 is swung upward to open the conveyance path 202*a*, the front cover 262 can also be opened upward. That is, both the tray unit 260 and the front cover 262 are movable in the vertical direction. Accordingly, in the second comparative example in which the front cover 262 is integrally formed with the tray unit 260, a user visually recognizes the conveyance path 202*a* within the range where the line of sight indicated by arrow b in FIG. 14 reaches. On the contrary, in the present embodiment, the user visually recognizes the conveyance path 202*a* within the range where the line of sight indicated by arrow a in FIG. 14 reaches, that is, the operator can see the conveyance path 202*a* farther to the rear side than the second comparative example. Therefore, the user can easily remove the jammed sheet P.

As described above, according to the present disclosure, a sheet remaining in a conveyance path can be easily removed.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. A conveyance device comprising:

a tray on an upper surface of the conveyance device, the tray configured to receive sheets output from an opening in a device body of the conveyance device while being swingably open to access an upstream conveyance path; and a guide forming a plurality of conveyance paths, the guide including an upper guide and a lower guide, the plurality of conveyance paths including the upstream conveyance path, a portion of the upper guide associated with the upstream conveyance path being attached to an underside of the tray such that the upper guide is movable together with the tray swing open to separate the portion of the upper guide from a respective portion of the lower guide to open the upstream conveyance path to access the sheets held therein.

2. The conveyance device according to claim 1, wherein the tray and the upper guide are swingable upward.

3. The conveyance device according to claim 2, further comprising a retainer configured to retain a state in which the tray and the upper guide have been swung upward.

4. The conveyance device according to claim 2, wherein the device body is not directly above the tray such that a range of upward movement of the tray as the tray and the upper guide swing upward unobstructed by the device body of the conveyance device.

5. The conveyance device according to claim 1, further comprising:

a sheet detector configured to detect a sheet jam; and circuitry configured to control conveyance of the sheets, wherein, when the sheet detector detects the sheet jam, the circuitry stops the sheets located in the upstream conveyance path and purges the sheets located at a position downstream from the upstream conveyance path to the tray in a sheet conveyance direction.

6. The conveyance device according to claim 1, further comprising:

a tray unit integrally constructed of the tray and the upper guide, a front side of the tray unit being movable in a vertical direction around a rear side of the tray unit serving as a rotation fulcrum; and a rear frame behind the tray unit, wherein a gap is disposed between a rear face of the tray unit and the rear frame, and wherein a step is formed between the tray unit and the rear frame when the front side of the tray unit is lifted.

7. The conveyance device according to claim 1, further comprising:

a tray unit integrally constructed of the tray and the upper guide;

a front cover in front of the tray unit, being closably openable; and an operation member on a front face of the tray unit, having a length that is accommodated in the front cover when the front cover is closed.

8. The conveyance device according to claim 1, further comprising:

a tray unit integrally constructed of the tray and the upper guide, a front side of the tray unit being movable in a vertical direction around a rear side of the tray unit serving as a rotation fulcrum; and a front cover in front of the tray unit, being closably openable in the vertical direction.

9. A liquid application device comprising:

the conveyance device according to claim 1; and an application device configured to apply a coating liquid to the sheets.

10. A printer comprising:

the liquid application device according to claim 9; and an image forming unit configured to form an image on the sheets.

11. A sheet conveyance apparatus comprising:

the application device according to claim 9; and a loading device disposed upstream from the application device in a sheet conveyance direction and configured to forward the sheets to the application device, wherein the loading device includes an extension tray on an upper surface of the loading device, and wherein the extension tray is configured to extend the tray.

12. The sheet conveyance apparatus according to claim 11, wherein the loading device includes another upper guide below the extension tray, said another upper guide configured to define another conveyance path in which the sheets are conveyed, and wherein said another upper guide is movable together with the extension tray to open said another conveyance path below the extension tray.

13. A printer comprising:

the conveyance device according to claim 1; and an image forming unit configured to form an image on the sheets.

14. A sheet conveyance apparatus comprising:

the conveyance device according to claim 1; and a loading device disposed upstream from the conveyance device in a sheet conveyance direction and configured to forward the sheets to the conveyance device, wherein the loading device includes an extension tray on an upper surface of the loading device, and wherein the extension tray is configured to extend the tray.

15. The sheet conveyance apparatus according to claim 14, wherein the loading device includes another upper guide below the extension tray, said another upper guide configured to define another conveyance path in which the sheets are conveyed, and wherein said another upper guide is movable together with the extension tray to open said another conveyance path below the extension tray.

16. The conveyance device according to claim 1, further comprising:

a handle on a front face of the tray, wherein, in a depth direction of the device body, the handle does not protrude further than the device body.

17. The conveyance device according to claim 1, further comprising:

a controller configured to perform a purge operation upon detection of a sheet jam of one or more of the sheets, the purge operating including instructing the guide to purge, via the opening, the sheets located within ones of the plurality of conveyance paths downstream of an application device and instructing the guide to hold the sheets located within the upstream conveyance path, wherein the sheets held within the upstream conveyance path are accessible to a user when the tray is swung open.

* * * * *